United States Patent [19]

Landers

[11] 4,279,546

[45] Jul. 21, 1981

[54] GROUT SEAL PREMATURE INFLATION PROTECTIVE SYSTEM

[75] Inventor: Don B. Landers, Arlington, Tex.

[73] Assignee: Oil States Rubber Company, Arlington, Tex.

[21] Appl. No.: 42,795

[22] Filed: May 29, 1979

[51] Int. Cl.[3] ..... E02D 5/14

[52] U.S. Cl. ..... 405/225; 405/227

[58] Field of Search ..... 405/225, 227, 224, 195, 405/203–208, 226, 228

[56] References Cited

U.S. PATENT DOCUMENTS

| | | | |
|---|---|---|---|
| 3,564,856 | 2/1971 | Blount et al. | 405/225 |
| 4,063,421 | 12/1977 | Coone et al. | 405/225 |
| 4,063,427 | 12/1977 | Hoffman | 405/225 |
| 4,140,426 | 2/1979 | Knox | 405/225 |

*Primary Examiner*—Dennis L. Taylor

*Attorney, Agent, or Firm*—Warren H. Kintzinger

[57] ABSTRACT

Offshore platform leg jacket and piling sets having inflatable grout seals with inflation lines extended to the outside of respective jackets and upward to the top of the jackets each equipped with a premature inflation prevention structure low in the inflation line preventing fluid hydrostatic pressure from causing premature grout seal inflation. The structure inserted low in each inflation line is in the form of a rupture disc or, alternately, a pressure controlled relief valve so selected and/or set that the hydrostatic fluid pressure required to burst the rupture disc or to open activate the relief valve is always higher than the maximum hydrostatic pressures the respective grout seals are exposed to.

8 Claims, 6 Drawing Figures

Figure 5:
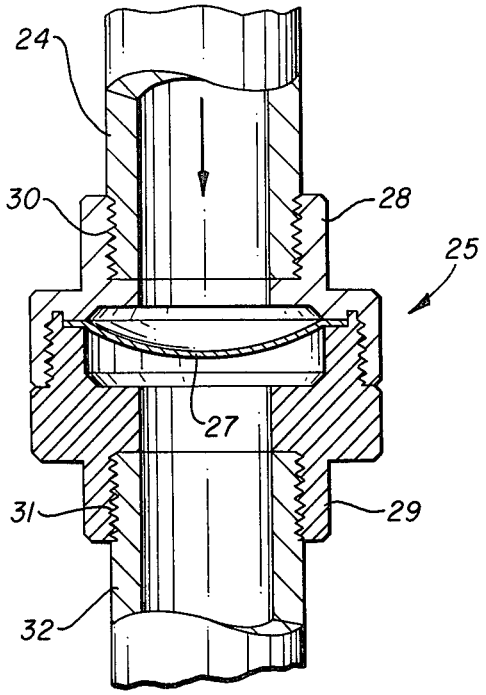

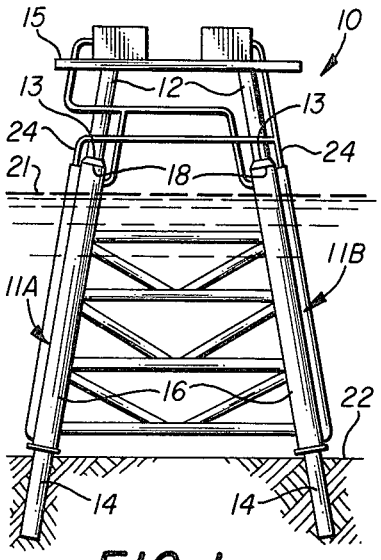
FIG. 1
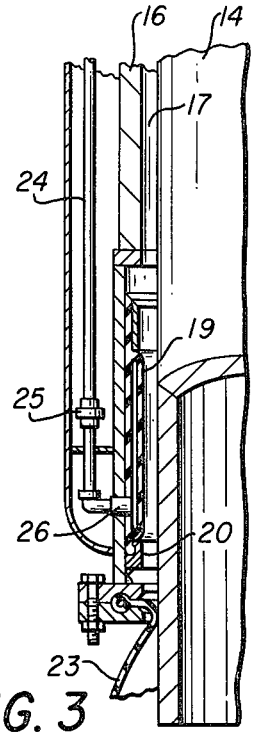
FIG. 3
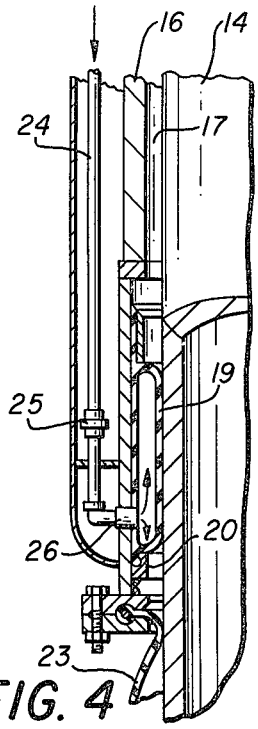
FIG. 4
FIG. 2
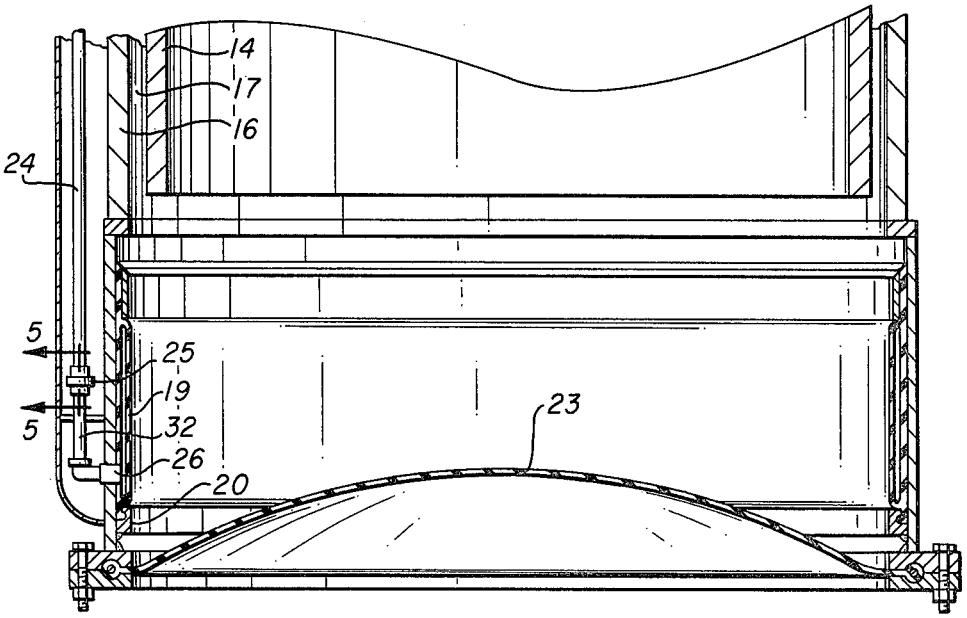

GROUT SEAL PREMATURE INFLATION PROTECTIVE SYSTEM

This invention relates in general to offshore marine platform structures employing multiple legs of piling and piling sleeve annulus subject to being filled with grout after piles have been driven and grout seals have been inflated, and more particularly, to grout seal inflation lines with anti-premature inflation structure low in lines preventing gravity induced fluid hydrostatic pressure in the lines from causing premature grout seal inflation.

In erecting an offshore marine platform structure, the practice generally is to fabricate the platform structure on land, seal the hollow leg and brace members, and then tow it to the desired site for installation, using the sealed leg members as flotation pontoons. Then, the leg members are flooded at controlled rates to erect the platform structure. A typical method for securing the structure to the floor of the offshore site is by driving piles into the floor, through piling guide sleeves mounted on the legs. The pile is then made unitary with the sleeve through which it passes by filling the annulus between the pile and the sleeve with a grouting material such as concrete. After the pile is driven into place, and prior to filling the annulus with grout, a sleeve packer may typically be inflated to seal the annulus . Such an inflatable packer is described in U.S. Pat. No. 3,468,132, for example, assigned to the assignee of this invention.

There have been failures of inflatable grout seals on offshore platforms such as with installations in the North Sea through inadequacies in the design and installation of grout seal inflation systems. In one offshore platform installation eight legs extended from the ocean floor to above sea level, and twelve skirt sleeves from the ocean floor upward approximately 120 feet. Grout seals with diaphragm closures were positioned on the bottom of all main legs and top and bottom of all skirt sleeves with the diaphragm closures being, in all cases, for buoyancy of the legs and sleeves. The procedure used in installing the offshore platform jacket structure in this instance was to transport it with a barge to the offshore location and then slide it off the barge into the sea, where it floats in a horizontal position until the upending procedures begin.

The up-ending is activated by means of a controlled flooding system in the jacket legs and skirt sleeves. While the jacket is still horizontal, most of the structure is submerged, part of it containing four legs and six skirt sleeves may be over 100 feet deep but still sealed where the hydrostatic differential between the sea and the inside of legs and skirts is 45 psi or more. With this structure the inflatable grout seals are on the inside of the legs and skirts and the grout seal inflation lines are extended to the outside of the jacket and directed to the top of the jacket. These inflation lines on the jacket were of steel construction with many joints connected by welding. The design plan is such that grout seals are not to be inflated until the piling is driven through all main legs and skirts to position ready for grouting. However, in the event of premature inflation before piles are driven the elastomeric seals extend into the path of respective piling to be destructively torn loose as piles are driven.

Grout seal inflation piping is normally tested in the fabrication yard prior to transporting the jacket structure to sea with testing by hydrostatic means from the top of the jacket down to the inflation assembly of each grout seal. After testing in each instance water in the lines is supposed to be purged with compressed air but this may not always be completely accomplished. Further, there were numerous breaks and weld cracks in steel piping derived from flexing of the jacket legs and skirts in loadout and transporting and through vortex fluttering during launch and through jacket up-ending. Cracks or breaks in grout seal inflation piping allow sea water to enter the grout seals and cause premature inflation since the legs and skirts have less pressure inside than the hydrostatic environmental pressure outside. Without such leaks the problem may still exist with any water that had not been removed after hydrostatic testing in the fabrication yard causing premature inflation because of the weight of the water, even so little as a five foot column causing grout seal inflation.

It is therefore a principal object of this invention to provide piling and piling sleeve grout seal inflation piping with hydrostatic fluid presure protection preventing premature grout seal inflation by any level of gravity induced hydrostatic pressure in the piping lines.

Another object is to provide such protection with protective structure activated for grout seal inflation only by applied fluid pressures higher than the maximum gravity induced hydrostatic pressures grout seals are otherwise exposed to.

A further object with such hydrostatic protective structure in grout seal piping lines is to prevent destruction of grout seals by the driving of piles through preinflated grout seals that should be inflated only after the pilings have been driven.

Features of the invention useful in accomplishing the above objects include, in an offshore platform jacket leg and piling set grout seal premature inflation protective system, grout seal inflation lines equipped with anti-premature inflation structure low in the lines positioned such as to prevent gravity induced hydrostatic pressure in the lines from causing premature grout seal inflation even with hydrostatic testing of the lines from the top of the jacket down to the anti-premature inflation structure in each line adjacent the seals prior to transporting of the jacket to sea. In one embodiment the anti-premature inflation structure low in the lines is in the form of a rupture disc so selected as to rupture only with an applied fluid pressure higher than the maximum hydrostatic pressures the respective grout seals would otherwise be exposed to. In another embodiment the anti-premature inflation structure is in form of a pressure controlled relief valve so selected and set as to be open activated by an applied fluid pressure higher than the maximum hydrostatic pressures the respective grout seals would otherwise be exposed to.

Specific embodiments representing what are presently regarded as the best modes of carrying out the invention are illustrated in the accompanying drawings.

Figure 6:
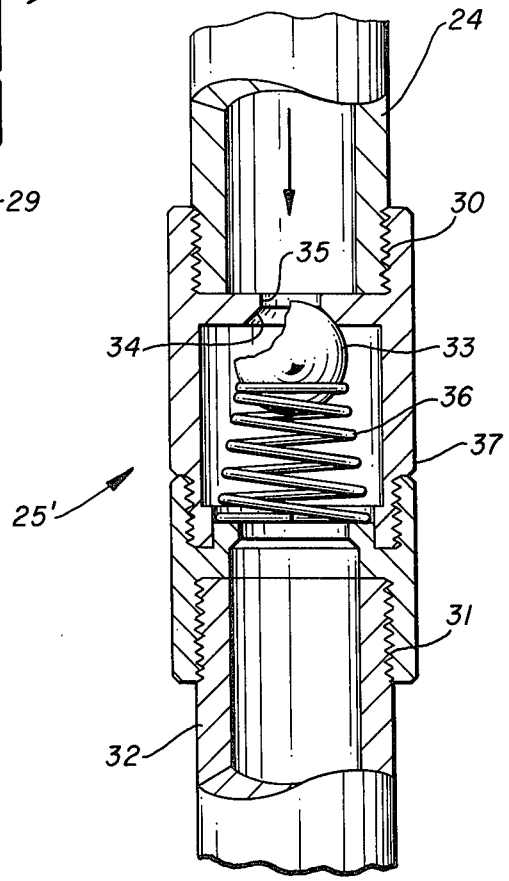

In the drawings:

FIG. 1 represents an elevation view of an offshore marine platform structure equipped for grouting;

FIG. 2, a partial broken away and sectioned elevation view of a platform leg showing leg piling and sleeve annulus detail with grout seal and grout line shown with the grout seal in the uninflated state and before the pile is driven;

FIG. 3, a partial broken away and sectioned view of an inflatable packer seal before inflation with the pile driven through a leg diaphragm seal;

FIG. 4, a partial broken away and sectioned view of the inflatable packer seal after inflation sealing the annulus between the leg shield and the driven piling;

FIG. 5, a partial and broken away view of premature inflation prevention structure for a grout seal in the form of a rupture disc positioned low in a grout seal inflation line; and, FIG. 6, a partial and broken away view of a pressure controlled relief valve positioned low in a grout seal inflation line.

Referring to the drawings:

The offshore structure 10 of FIG. 1 is equipped with a number of downwardly extending legs such as legs 11A and 11B that have upward extensions 12 fastened as by welding to the top plates 13 of the legs 11A and 11B. Top plates 13 on the top of the inner cylindrical piling tubes 14 of the legs 11A, 11B and back legs 11 support extensions 12 and the service platform 15 mounted thereabove. Each leg 11 also includes a piling sleeve 16 that forms an annulus 17 with the piling tube 14 of that leg 11 sealed at the top by truncated conical top plate 18 welded in place so as to completely seal the annulus 17 after the pile 14 has been driven. The top plates 18 that could be flat instead of truncated cones or even an annular extension of top plates 13 also serve to help hold the piling sleeves 16 in proper spaced relation to their respective piling tubes 14. An inflatable grout seal 19 is set in place within the bottom of leg piling sleeve 16, as shown in FIG. 2, mounted on and extending above grout seal mounting ring 20, and after the pile 14 is driven and grout seal 19 is inflated from the uninflated state of FIGS. 2 and 3 to the inflated state it acts as a back pressure seal for retaining grout as it is inserted into the annulus 17 and also aids in holding piling sleeve 16 and its piling tube 14 in proper spaced relation. The legs 11 generally extend from above the water surface 21 to below the mud line 22 at the seabed with it being recognized that some legs of some offshore platforms do not extend into the seabed. Further, the inner cylindrical piling tubes 14, as a general rule, are longer than their piling sleeves 16 so as to be pile driven into the seabed further than the piling sleeves 16 that may or may not so extend.

The inflatable grout seal 19 is inflated from the uninflated state of FIGS. 2 and 3 to the inflated state of FIG. 4 after the piling tube 14 in pile driving ruptures the diaphragm 23 and is driven to the final pile set state such as indicated in FIG. 1. Fluid pressure (generally air pressure) applied through inflation line 24 and through grout seal premature inflation prevention device 25 over a predetermined pressure level is effective to inflate the grout seal 19. The predetermined pressure level for pressure activation to the open state of grout seal inflation line device 25 is so selected as to be consistent with the depth of the grout seal 19 in water with different size jackets adapted to use with specific location seabed depths. Various calculations for grouting packer (grout seal) pressure are considered, for example, with a typical installation—(A) water depth to packer 850 feet, (B) work platform height above water 20 feet, (C) grout density 120 (16.1 lb. grout), $$(P)\ (\text{pressure maximum}) = \frac{(A + B)(C)}{144} = \frac{(850 + 20)(120)}{144} = 725 \text{ p.s.i. plus } 100 \text{ p.s.i. safety} = 825 \text{ p.s.i.}$$

that grout lines in this instance should be tested to. In this case the premature inflation prevention device 25 must be such as to resist up to as much as 825 p.s.i. pressure before opening with the device 25 low in the inflation line 24 adjacent the input fitting 26 to grout seal 19. Obviously, 825 P.S.I. pressure in the specific example exceeds the maximum hydrostatic pressure the grout seals would be exposed to even if premature inflation prevention devices 25 were not included in inflation lines 24 in the offshore platform jacket as constructed for 850 feet water depth.

Referring also to FIG. 5 grout seal premature inflation prevention device 25 is shown to be in the form of a rupture disc 27 mounted between threaded together fittings 28 and 29 that together are connected by being threaded to threaded ends 30 and 31 of line 24 and a short line 32 as a coupling interconnect therebetween. With this structure rupture discs 27 are individually selected for rupture pressure valves tailored to and exceeding the maximum hydrostatic pressure ever encountered in construction yard testing or through water leakage into inflation lines 24. When grout seal inflation is timely and required sufficiently high pressure is applied for controlled rupture of rupture discs 27 to thereafter permit inflation of the grout seals 19 for appropriate use as annulus 17 packers after piling 16 has been driven.

The grout seal premature inflation prevention device 25' of FIG. 6 is another embodiment in the form of a fluid pressure controlled relief valve. The valve 25' is shown to have a ball 33 spring biased into seating engagement with valve seat 34 at valve opening 35 by coil spring 36 within threaded together valve body 37. The pressure relief valve assembly 25 is threaded to threaded ends 30 and 31 of line 24 and the short line 32 as a coupling interconnect therebetween. With this structure the coil spring 36 is so selected and set for pressure relief valve opening tailored to and exceeding the maximum hydrostatic pressure ever encountered in construction yard testing or through water leakage into inflation lines 24.

Whereas this invention is herein illustrated and described with respect to particular embodiments thereof, it should be realized that various changes may be made without departing from essential contributions to the art made by the teachings thereof.

I claim:

1. In a grout seal premature inflation protection system: a piling and piling sleeve structure forming an annulus; an inflatable seal mounted in place within the bottom of said piling sleeve structure to form a seal at the bottom of said annulus upon inflation after the piling has been driven; seal inflation line means extended from fluid pressure application means to said inflatable seal; and anti-premature inflation structure means positioned low in said seal inflation line means and structured such as to prevent gravity induced hydrostatic pressure in said seal inflation line means from causing premature inflation of said inflatable seal before driving of said piling.

2. The grout seal premature inflation protection system of claim 1, wherein said anti-premature inflation structure means is pressure responsive to open with an applied fluid pressure on said anti-premature inflation structure means higher than the maximum hydrostatic pressure said inflatable seal would otherwise be exposed to.

3. The grout seal premature inflation protection system of claim 2, wherein said anti-premature inflation structure means includes a rupture disc selected to rupture only at a predetermined applied fluid pressure higher than the maximum hydrostatic pressure said inflatable seal would otherwise be exposed to for the water depth that said inflatable seal is located with said piling and piling sleeve structure in place in water with said piling driven into the seabed.

4. The grout seal premature inflation protection system of claim 3, wherein said rupture disc is mounted in housing means positioned low in said seal inflation line means adjacent said inflatable seal.

5. The grout seal premature inflation protection system of claim 2, wherein said anti-premature inflation structure means includes a pressure controlled relief valve selected to open only at said applied fluid presure higher than the maximum hydrostatic pressure said inflatable seal would otherwise be exposed to for the water depth that said inflatable seal is located with said piling and piling sleeve structure in place in water with said piling driven into the seabed.

6. The grout seal premature inflation protection system of claim 5, wherein said pressure controlled relief valve is a spring biased pressure relief ball valve in housing means positioned low in said seal inflation line means adjacent said inflatable seal.

7. The grout seal premature inflation protection system of claim 2, wherein said anti-premature inflation structure means is used with a plurality of piling and piling sleeve structures in an offshore platform jacket assembly designed for a predetermined water surface to seabed depth and the anti-premature inflation structure means for each inflatable seal selected for the specific water depth of the specific offshore platform structure.

8. The grout seal premature inflation protection system of claim 7, wherein said piling and piling sleeve structure forming an annulus are part of an offshore platform jacket with a plurality of said piling and piling sleeve structure combinations as legs and skirts with diaphragm closure means on the bottoms of said legs and skirts for buoyancy of the offshore platform jacket structure in generally a horizontal posture until upending of the jacket is undertaken at location with each diaphragm closure means remaining intact until pierced by piling being driven.

* * * * *